US009985353B1

(12) United States Patent
Pajona et al.

(10) Patent No.: US 9,985,353 B1
(45) Date of Patent: May 29, 2018

(54) ANTENNA SYSTEM FOR METALLIZED DEVICES

(71) Applicants: Olivier Pajona, Nice (FR); Laurent Desclos, San Diego, CA (US); Abhishek Singh, San Diego, CA (US)

(72) Inventors: Olivier Pajona, Nice (FR); Laurent Desclos, San Diego, CA (US); Abhishek Singh, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 13 days.

(21) Appl. No.: 14/503,272

(22) Filed: Sep. 30, 2014

Related U.S. Application Data

(60) Provisional application No. 61/884,934, filed on Sep. 30, 2013.

(51) Int. Cl.
*H01Q 1/24* (2006.01)
*H01Q 9/04* (2006.01)

(52) U.S. Cl.
CPC ..... *H01Q 9/0442* (2013.01); *H01Q 1/243* (2013.01)

(58) Field of Classification Search
CPC ..... H01Q 9/0442; H01Q 1/242
USPC ..... 343/700 MS
See application file for complete search history.

(56) References Cited

U.S. PATENT DOCUMENTS

2006/0160501 A1* 7/2006 Mendolia ..... H01P 5/04 455/125
2008/0106350 A1* 5/2008 McKinzie ..... H03H 7/40 333/17.3
2012/0009983 A1* 1/2012 Mow ..... H01Q 1/243 455/575.7
2013/0154897 A1* 6/2013 Sorensen ..... H01Q 7/005 343/861
2013/0201067 A1* 8/2013 Hu ..... H01Q 1/243 343/745
2013/0307740 A1* 11/2013 Pajona ..... H01Q 7/00 343/748
2014/0333495 A1* 11/2014 Vazquez ..... H01Q 9/06 343/745

* cited by examiner

*Primary Examiner* — Dameon E Levi
*Assistant Examiner* — David Lotter
(74) *Attorney, Agent, or Firm* — Dority & Manning, P.A.

(57) ABSTRACT

An embedded antenna system is described for use with metallized enclosures and housings used with wireless communication devices. One or multiple radiators are coupled to a metal cover, with ground points established on the metal cover to improve radiation efficiency and control the frequency response of the antenna system. Dynamic tuning methods are described wherein detuning of the antenna system from sources such as body-loading are compensated by adjusting impedance properties of the combination of radiator and metallized cover.

15 Claims, 13 Drawing Sheets

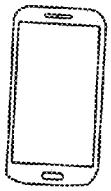
FIG.2A
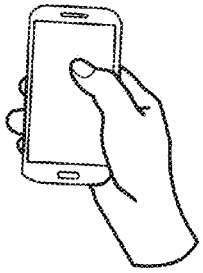
FIG.2B
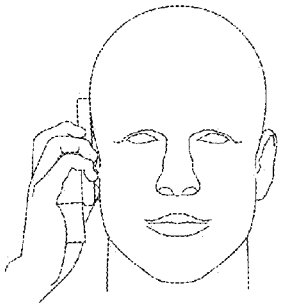
FIG.2C
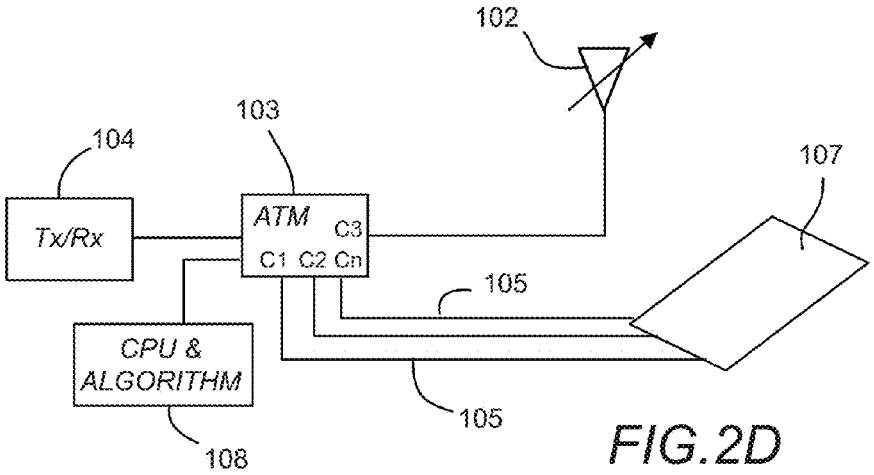
FIG.2D
Antenna tuning inputs
| | | | |
|---|---|---|---|
| Use case 1 | C1,1 | C1,2 | C1,n |
| Use case 2 | C2,1 | C2,2 | C2,n |
| … | … | … | … |
| … | … | … | … |
| … | … | … | … |
| Use case m | Cm,1 | … | Cm,n |
FIG.2E

ANTENNA SYSTEM FOR METALLIZED DEVICES

CROSS-REFERENCE TO RELATED APPLICATIONS

This application claims benefit of priority with U.S. Provisional Application Ser. No. 61/884,934, filed Sep. 30, 2013; the contents of which are hereby incorporated by reference.

FIELD OF INVENTION

The present invention relates generally to the field of wireless communication. In particular, the present invention relates to embedded antenna systems configured with metallized enclosures for use in wireless communication.

BACKGROUND OF THE INVENTION

As new generations of wireless communication devices become smaller and packed with more multi-band functions, designing antenna systems for such devices becomes more challenging. In particular, a communication device with an air interface tends to be affected by use conditions such as the presence of a human hand, a head, a metal object and other interference-causing objects placed in the vicinity of an antenna, resulting in impedance mismatch at the antenna terminal. Designing internal antennas for devices that have partial or complete metallized back covers, such as a metal back cover on a cell phone or Tablet adds an additional parameter that needs to be optimized if good antenna performance is to be maintained. Accordingly, novel antenna design techniques are needed to provide efficient antenna performance for internal antennas when integrated into communication devices that have metallized housings or covers. Ideally, these novel techniques need to have little or no impact on the aesthetics of the industrial design.

As the cellular mobile communications industry transitions from 2G/3G standards to 4G standards the cellular antenna system in the mobile device is required to transition from a one antenna to a two antenna system. This is required to meet the multi-input multi-output (MIMO) architecture used in 4G long term evolution (4G LTE) standard. When other antenna functions in a modern mobile communication device are considered the number of antennas can increase to five. In a typical design engagement for a mobile device where a metal housing is not implemented, considerable time is spent not only designing these five antennas, but also determining optimal placement and orientation to achieve the necessary levels of isolation between the various antennas, as well as correlation coefficient between the two MIMO antennas. Adding a metallized housing to the design process will significantly complicate the antenna system design process.

The MIMO requirement brought about by the 4G LTE standard complicates the antenna system design process due to the addition of the second cellular antenna and the risk of antenna de-tuning of both antennas as a function of the use cases for the mobile device. Use cases may include: hand use, head and hand, or placement of the device on a table or other surface, among others. The complications incurred regarding MIMO antenna system design increase when a metallized housing or cover is considered, due to the direct loading of the metal cover with a user's hand or contact with a surface such as a wooden table, metal file cabinet, or other materials. With cellular communication systems becoming more loaded and capacity constrained, the antenna systems on the mobile side of the communication link are expected to become more efficient to assist in maintaining a level of acceptable network performance. Under-performing mobile devices in regard to the radiated performance of the device will degrade the cellular network, with these under-performing devices requiring more system resources compared to more efficient mobile devices.

Several solutions have been proposed over the years to improve the Total Radiated Power (TRP) and Total Isotropic Sensitivity (TIS) performance of the cellular antenna or to fulfill Specific Absorption Rate (SAR) and Hearing Aid Compatibility (HAC) requirements. Though various passive antenna techniques and topologies have been proposed and developed to improve antenna efficiency for internal applications, they all suffer from the limitation of being optimized for a single use case such as device in user's hand, device against the user's head, or device in free space environment. Implementing a tunable antenna, one where the antenna impedance properties can be modified dynamically, can provide an antenna system that can be optimized for a wider variety of use cases. A common technique for implementing a tunable antenna is to design a tunable capacitor into a passive matching circuit, with the matching circuit located at the feed point of the antenna and used to match the antenna. With tunable antennas implemented for both antennas in a MIMO antenna system inside a mobile device with metal cover or housing, the antennas can be dynamically impedance matched as loading of the metal cover is changed or altered.

SUMMARY

An embedded antenna system is described for use with metallized enclosures and housings used with wireless communication devices. One or more radiators are coupled to a metal cover, with ground points established on the metal cover to improve radiation efficiency and control the frequency response of the antenna system. Dynamic tuning methods are described wherein detuning of the antenna system from sources such as body-loading are compensated by adjusting impedance properties of the combination of radiator and metallized cover.

BRIEF DESCRIPTION OF THE DRAWINGS

FIGS. 2(A-C) illustrate use cases typically encountered with a mobile wireless device such as free space, device in hand, and device in hand against the head, respectively.

FIG. 2D shows the antenna system of FIG. 1B configured to adjust the antenna system based on an instantaneous use case.

FIG. 2E shows a lookup table stored in memory containing antenna tuning inputs for determining a configuration of the antenna tuning module (ATM) associated with the antenna system.

DETAILED DESCRIPTION OF THE INVENTION

Figure 1A:
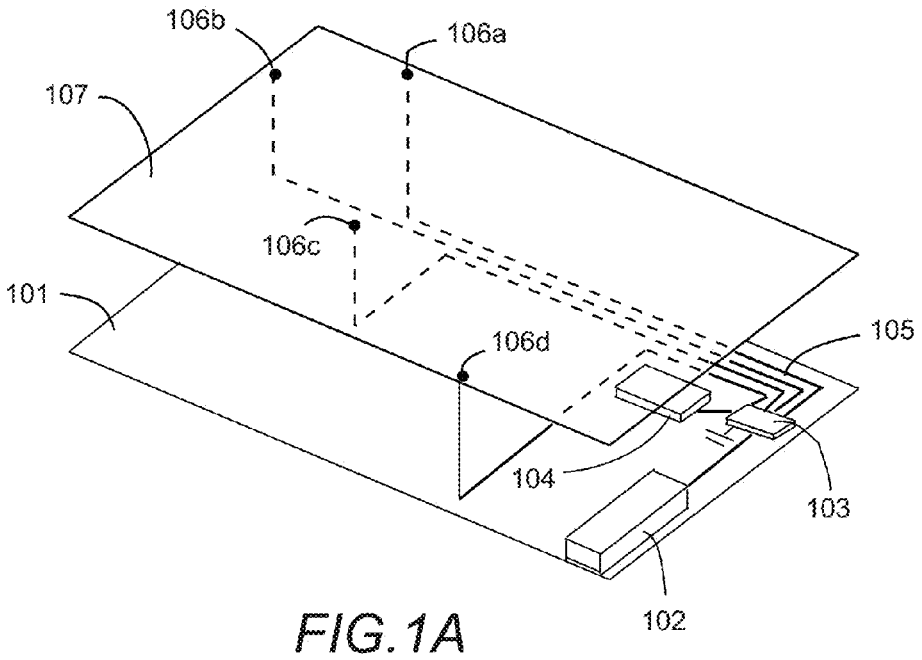
FIG. 1A illustrates an antenna system configured to couple to and excite currents on a metal housing, which results in radiation from the antenna/metal housing combination.

An embedded antenna system is described for use with metallized enclosures and housings used with wireless communication devices. One or multiple antennas can be coupled to a metal housing or cover, and the metal housing or cover becomes part of the antenna system. Dynamic tuning methods are described wherein detuning of the antenna system from sources such as body-loading are compensated by adjusting impedance properties of the combination of radiator and metallized cover.

In one embodiment, an antenna is positioned on a ground plane and excited with a transceiver. The ground plane can take the form of a ground layer of a printed circuit board. A metallized cover or housing is placed in close proximity to the antenna and ground plane. One or multiple connection points are formed, with one end of a connection point making contact with the metallized housing or cover and the other end of the connection point making contact with the ground plane that the antenna is positioned on. A tunable component is placed at the junction of the connection point and the ground plane, with the tunable component being a tunable capacitor, switch, PIN diode, varactor diode, phase shifter, or any component capable of generating a variable impedance. The connection points are located to optimize the impedance and radiation efficiency of the antenna/metallized cover combination. The tunable components are used to provide additional tuning or optimization.

In another embodiment, one or multiple tunable components are coupled to the antenna to provide the capability of adjusting the antenna impedance or frequency response to better adjust the coupling between the antenna and metallized housing.

In another embodiment, an algorithm is loaded into a processor, with the algorithm configured to control the tunable components at the junction of the connection points and ground plane and the tunable component/components coupled to the antenna. By measuring the impedance match at the antenna feed point, the algorithm can control the tunable components and dynamically alter the impedance match of the antenna/metallized housing combination.

In yet another embodiment, a conductor is positioned in close proximity to the metallized housing and is positioned between the metallized housing and the ground plane. One or multiple connection points are formed, with one end of a connection point making contact with this conductor and the other end of the connection point making contact with the ground plane that the antenna is positioned on. The separation distance between the conductor and the metallized housing can be adjusted to improve the frequency response, impedance properties, and/or radiated efficiency of the antenna/metallized housing combination. This second coupling gap, with the first coupling gap being generated between the antenna and metallized housing, can be optimized along with the first coupling gap, antenna design, and connection point design to optimize the antenna system.

In yet another embodiment, multiple conductors can be positioned in proximity to the antenna and the metallized housing to provide more degrees of freedom in optimizing the antenna. By varying the separation distance between adjacent conductors, multiple resonances can be generated to provide additional flexibility over the frequency response of the antenna system.

Now turning to the Drawings, in FIGS. 1 through 14, various embodiments and configurations of the antenna system are illustrated. Reference numbers are being consistently used throughout the drawings, wherein for example an antenna element of FIG. 1A and an antenna element of FIG. 14 are each labeled with the reference number (102). A reference signs list can be found below for faster reference.

FIG. 1A illustrates an example of an antenna system configured to couple to and excite currents on a metal housing, which results in radiation from the antenna/metal housing combination. An antenna element 102 is positioned on a circuit board, with the antenna element connected to an antenna tuning module (ATM) 103. A transceiver 104 is connected to the ATM 103. The antenna tuning module contains tunable components and/or control lines to alter the state of connection points formed between the metal housing and the ground layer 101 of the circuit board. An algorithm can be configured to control the impedance loading of the connection points 106*a*; 106*b*; 106*c*; 106*d* on the metal housing 107 to optimize performance of the antenna/metal housing combination. In the illustrated example of FIG. 1A, transmission lines 105 connect the antenna tuning module 103 to the connection points 106(*a-d*).

Figure 1B:
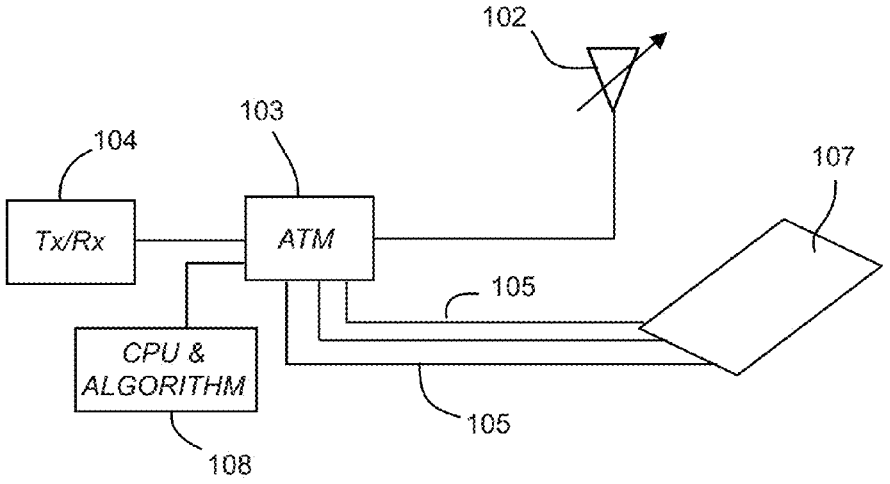
FIG. 1B shows a schematic of the antenna system of FIG. 1A.

FIG. 1B shows a schematic of the antenna system of FIG. 1A. The CPU and algorithm is shown external to the ATM; however, the ATM may contain an embedded processor and algorithm in certain embodiments.

Specific connection points are chosen to optimize antenna performance. The connection points can be used to ground the metal housing or to reactively load the metal housing for tuning the antenna system.

FIGS. 2(A-C) illustrate examples of use cases typically encountered with a mobile wireless device such as free space (FIG. 2A), device in hand (FIG. 2B), and device in hand against the head (FIG. 2C). As illustrated in FIG. 2D, tunable components in the ATM 103 are dedicated to either the antenna 102 or the metal housing 107. This provides an active antenna and a metal housing that can be dynamically adjusted in terms of impedance loading. Control lines C1 through Cn are shown emanating from the ATM and running to the antenna and metal housing, respectively. As illustrated in FIG. 2E, a table is shown where the various use cases are mapped to control signal settings. As shown, control lines are used to dynamically tune the antenna, and/or to dynamically load the metallized housing.

Figure 3:
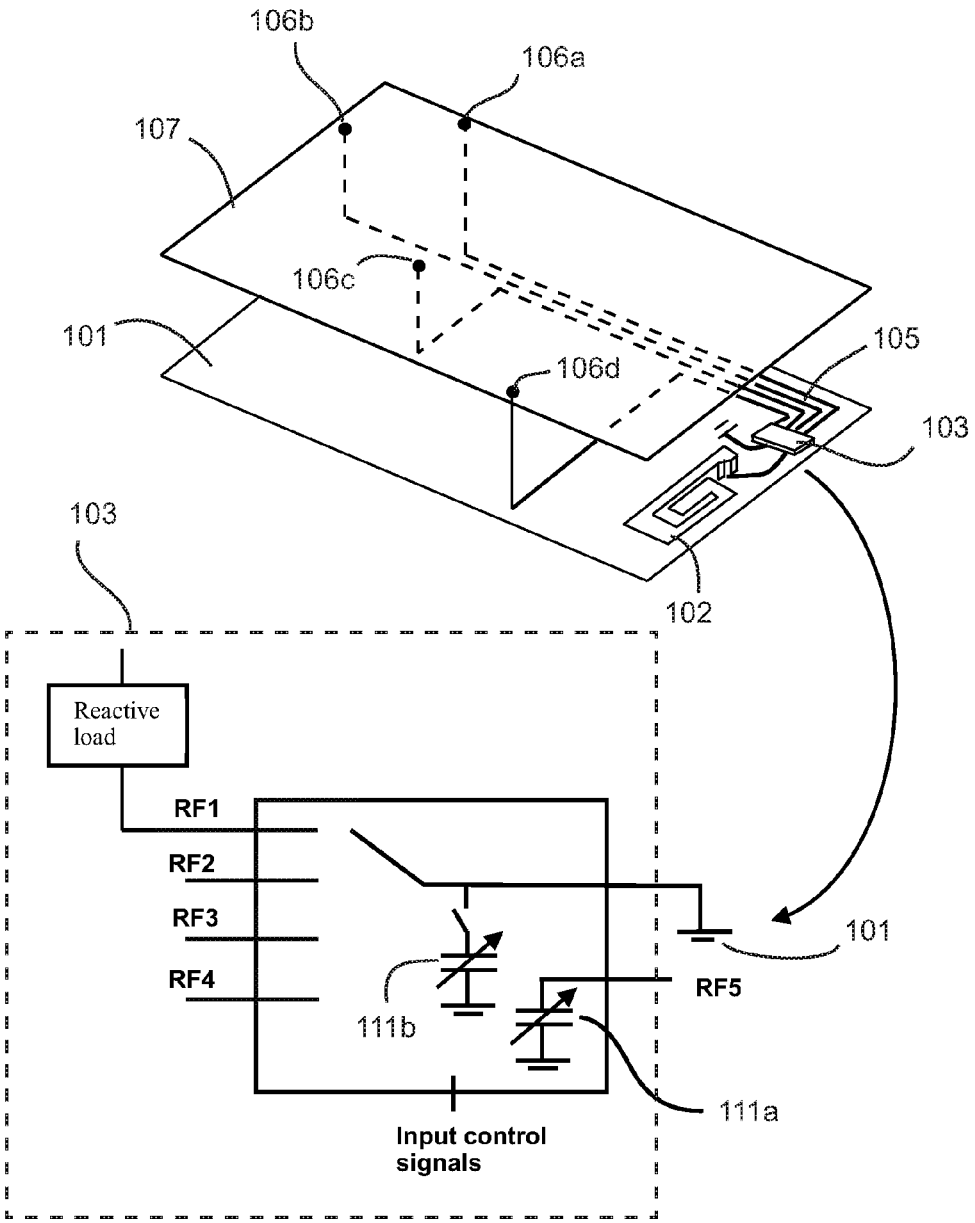
FIG. 3 illustrates an antenna system configured to couple to and excite currents on a metal housing, which results in radiation from the antenna/metal housing combination.

FIG. 3 illustrates an example of an antenna system configured to couple to and excite currents on a metal housing, which results in radiation from the antenna/metal housing combination. An antenna element 102 is positioned on a circuit board, with the antenna element connected to an antenna tuning module (ATM) 103. A specific circuit topology is shown for the ATM 103 in the expanded portion of FIG. 3, where a four port switch having ports (RF1-RF4) is configured with the common port connected to ground 101. The four ports of the switch can be used to connect to connection points 106(Aa-d) on the metal housing 107 via transmission lines 105 therebetween to alter the state of the connection. A tunable capacitor 111 in a shunt configuration can be connected to the four RF ports using a second switch. This tunable capacitor 111 can be used to dynamically tune the RF port being used. The port on the ATM labeled "RF5" is connected to a second tunable capacitor, with one end of the tunable capacitor grounded. This tunable capacitor can be used in a shunt configuration in the matching circuit at the feed point of the antenna to provide an active antenna configuration. Input signals are communicated to the ATM for configuring the carious tunable components, including switches, tunable capacitors, and the like.

Figure 4:
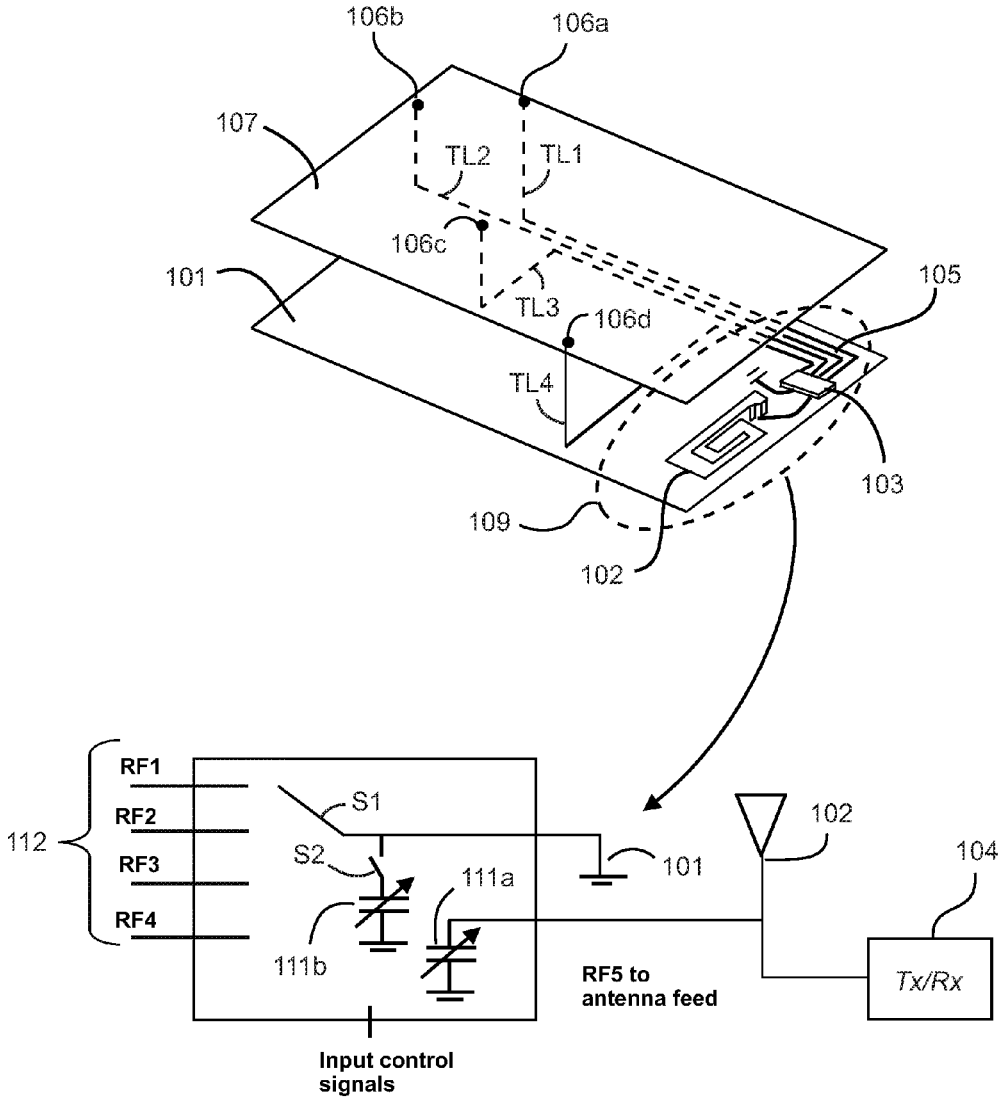
FIG. 4 illustrates an antenna system configured to couple to and excite currents on a metal housing, which results in radiation from the antenna/metal housing combination.

FIG. 4 illustrates an antenna system with an antenna element 102 configured to couple to and excite currents on a metal housing 107, which results in radiation from a combination of the antenna element and metal housing. A coupling region 109 is defined between the antenna element and the metal housing with this coupling region being controlled through variables such as separation distance between antenna and metal housing, shape of metal housing in vicinity of the antenna element, and antenna element design and tuning. A transceiver 104 labeled "Tx/Rx" is shown connected to the combination of antenna element 102 and the first tunable capacitor 111*a* which is located in the antenna tuning module (ATM) 103. The switch ports (RF1-RF4) of a first switch (S1) of the ATM are configured for direct loading of the metallized housing at the respective connection points (106*a*-106*d*). Transmission lines (TL1-TL4) each extend between the ATM 103 and a respective connection point (106*a*-106*d*, respectively). A second tunable capacitor 111*b* can be used to compensate the antenna system for changes in the coupling between the antenna element and the metallized housing, for example, the second tunable capacitor 111*b* can be coupled between the switch ports (RF1-RF4) and ground connection 101 as shown. Here, a second switch (S2) is shown for selectively coupling the second tunable capacitor 111*b* to the ground connection 101. Those with skill in the art will be capable of determining specific connection points (106*a*-106*d*) associated with the metallized housing for optimizing antenna system performance.

Figure 5:
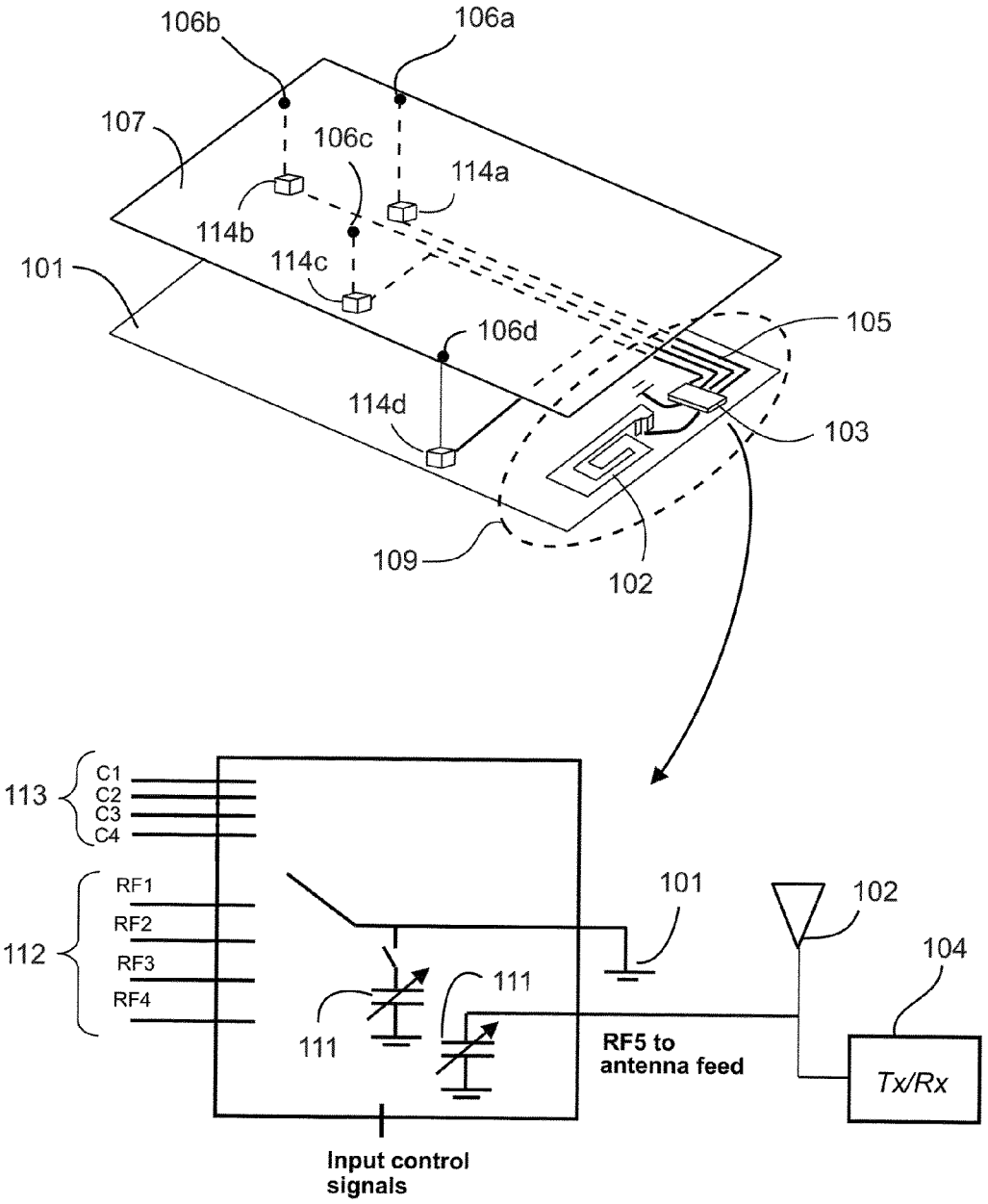
FIG. 5 illustrates an antenna system with a distributed architecture configured to couple to and excite currents on a metal housing, which results in radiation from the antenna/metal housing combination.

FIG. 5 illustrates an antenna system with a distributed architecture configured to couple to and excite currents on a metal housing, which results in radiation from the antenna/metal housing combination. An antenna element 102 is positioned on a circuit board, with the antenna element connected to an antenna tuning module (ATM) 103. The ATM has four RF ports 112 labeled "RF1, RF2, RF3, RF4" and four control signal ports 113 labeled "C1, C2, C3, C4". The RF switch ports are configured for reactively loading the connection points of the metallized housing; whereas the control signal ports are configured to control loading components positioned outside of the ATM and further coupled to connection points. This distributed architecture reduces the electrical delay between tuning components in the ATM and the connection points 106(*a*-*d*) by placing the tunable loading components 114(*a*-*c*) at the connection point and controlling the tuning component form the ATM.

Figure 6A:
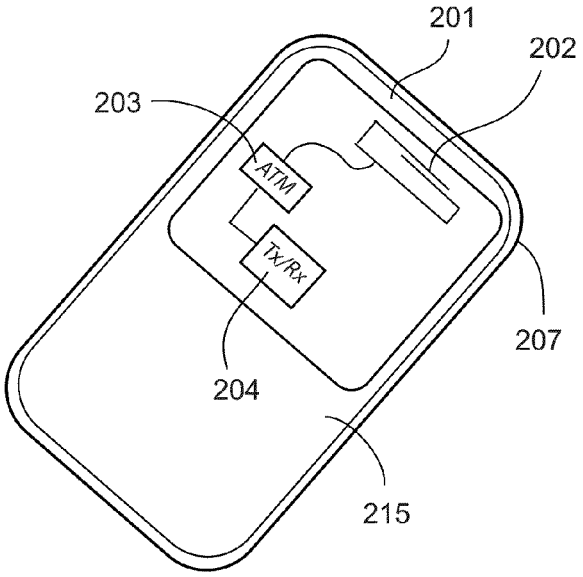
FIG. 6A illustrates a possible implementation of the active antenna system in a mobile device.
Figure 6B:
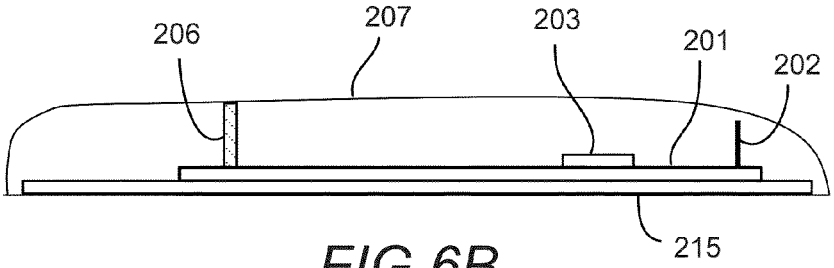
FIG. 6B shows a side view of the device wherein the antenna is positioned in close proximity to the metal housing.

FIGS. 6(A-B) illustrate a possible implementation of the active antenna system in a mobile device. The antenna element 202 is positioned in close proximity to the metal housing 207. A connection point 206 is shown with one end of the connection point attached to the metal housing 207 and the other end connected to the circuit board 201. An antenna tuning module (ATM) 203 is positioned on the circuit board and configured to vary a reactive loading of the connection point. Opposite of the circuit board is an LCD display 115 of the wireless device.

Figure 7:
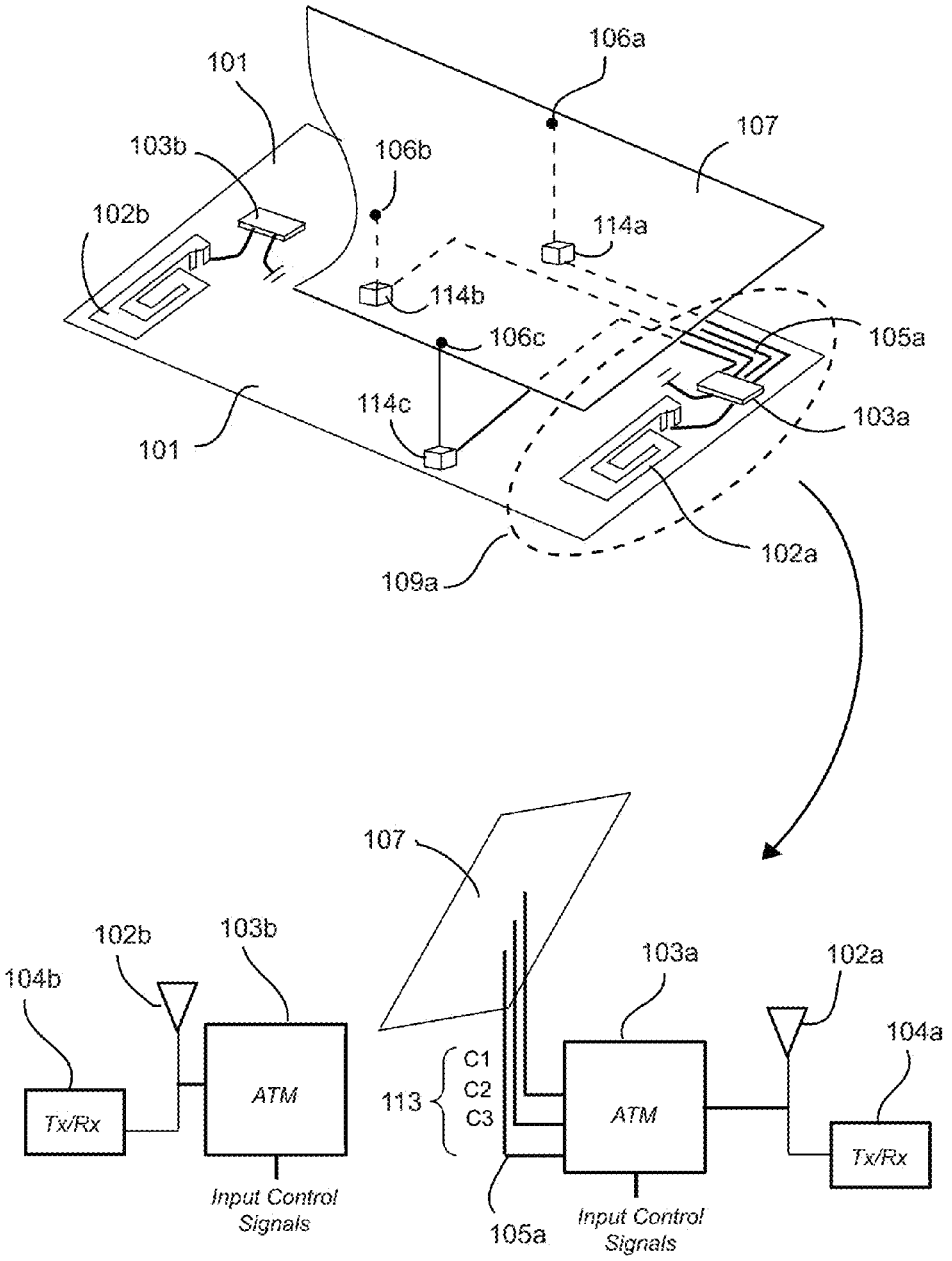
FIG. 7 illustrates a multi-antenna architecture using the active antenna system developed for use with a metal housing.

FIG. 7 illustrates a multi-antenna architecture using the active antenna system developed for use with a metal housing. A first antenna element 102*a* is positioned on one end of a circuit board with a second antenna element 102*b* positioned on the opposite end of the circuit board. Three connection points (106*a*; 106*b*; 106*c*) with distributed loads from loading components (114*a*; 114*b*; 114*c*) are shown, with the connection points used to connect the metal housing 107 to the ground layer 101 of the circuit board. The block diagram shows the first antenna element 102*a* connected to a first ATM 103*a*, with ATM 103*a* used to alter the connections of the connection points. The second antenna element 102*b* is connected to second ATM 103*b*, with ATM 103*b* used to provide active tuning of the second antenna element 102*b*. A coupling region 109*a* is shown as the region disposed between the first antenna element 102*a* and the metallized housing 107.

Figure 8:
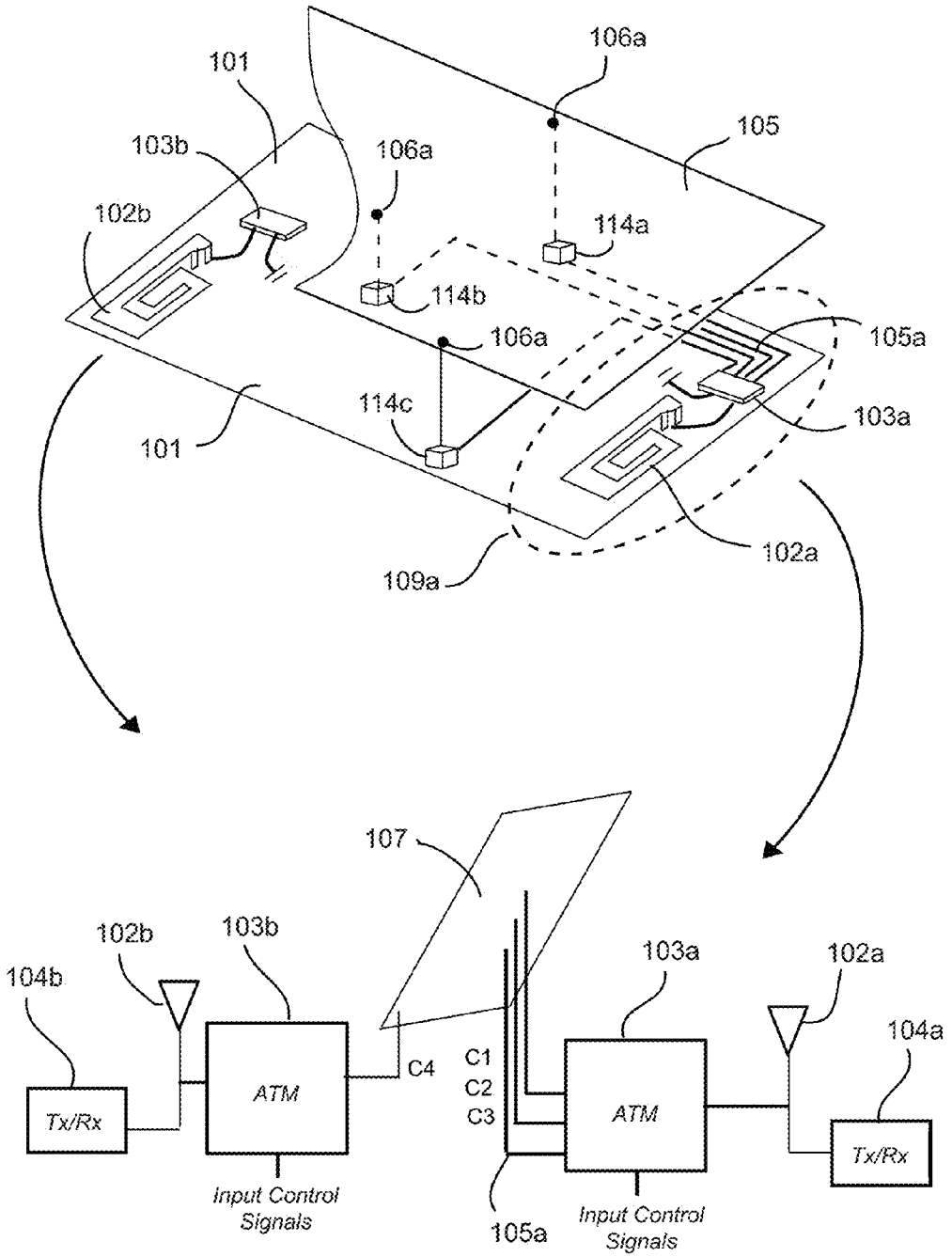
FIG. 8 illustrates a multi-antenna architecture using the active antenna system developed for use with a metal housing.

FIG. 8 illustrates a multi-antenna architecture using the active antenna system developed for use with a metal housing. First antenna element 102*a* is positioned on one end of a circuit board with second antenna element 102*b* positioned on the opposing end. Three connection points (106*a*; 106*b*; 106*c*) with distributed loads from corresponding tunable loading components (114*a*; 114*b*; 114*c*) are shown, with the connection points used to connect the metal housing 107 to the ground layer 101 of the circuit board. The block diagram shows first antenna element 102*a* connected to first ATM 103*a*, with first ATM 103*a* used to alter the connections of two of the connection points. Second antenna element 102*b* is connected to second ATM 103*b*, with second ATM 103*b* used to alter the connections of one of the connection points (C4).

Figure 9A:
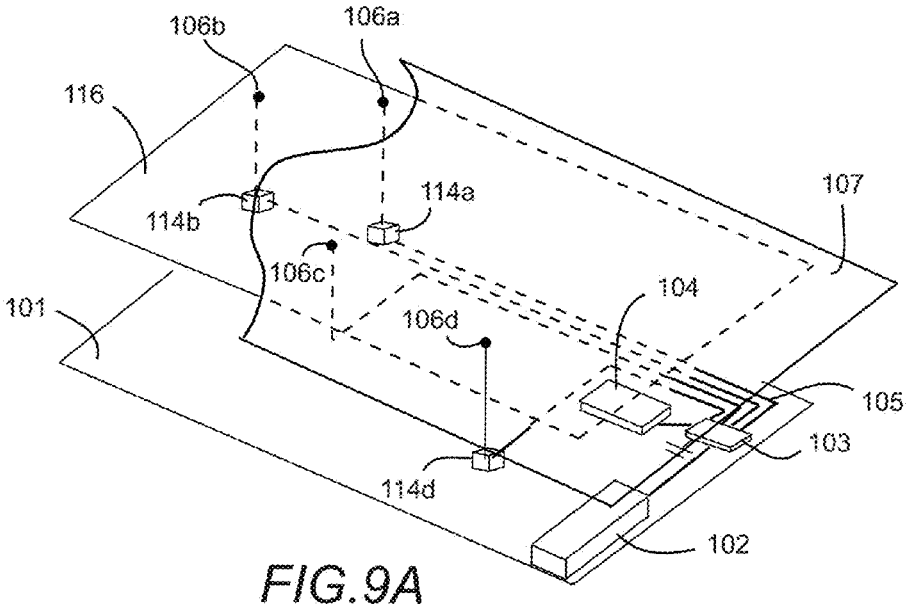
FIGS. 9(A-B) illustrate an antenna system configured to couple to and excite currents on a metal housing, which results in radiation from the antenna/metal housing combination.
Figure 9B:
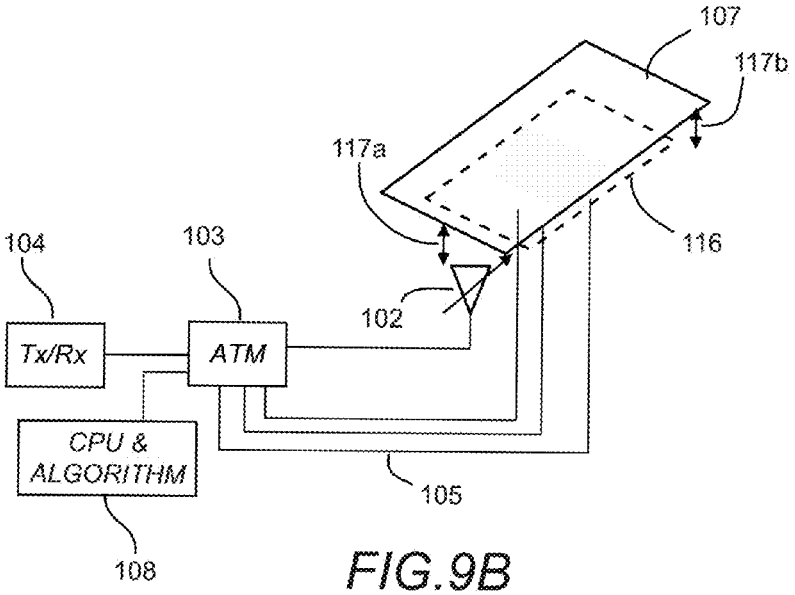

FIG. 9A illustrate an antenna system configured to couple to and excite currents on a metal housing, which results in radiation from the antenna/metal housing combination. An additional conductive layer referred to as a "coupling layer" has been added, with the coupling layer 116 positioned between the antenna element 102 and the metal housing 107. This coupling layer is positioned close to the metal housing, and the separation distance between the coupling layer and the metal housing is a parameter used to adjust the frequency response and impedance properties of the antenna/metal housing radiating system. One or multiple connection points 106(*a-b*) can be attached to the coupling layer 116 and one or multiple connection points 106(*c-d*) can be attached to the metal housing 107. In this example, two tunable loading components 114(*a-b*) are attached to the coupling layer 116 and one tunable loading component 114*d* is attached to the metal housing 107. In the block diagram of FIG. 9B, a single ATM 103 is shown which is used to alter the impedance loading of the metal housing 107 and coupling layer 116, and also tunes the antenna. first coupling region 117*a* is shown which is formed between the antenna element 102 and the metal housing 107. Second coupling region 117*b* is formed by the coupling between the metal housing 107 and the coupling layer 116. Coupling layers are added to provide additional control over current distribution of the coupled signal on the metal housing while tunable components in the ATM are used to optimize the antenna element.

Figure 10A:
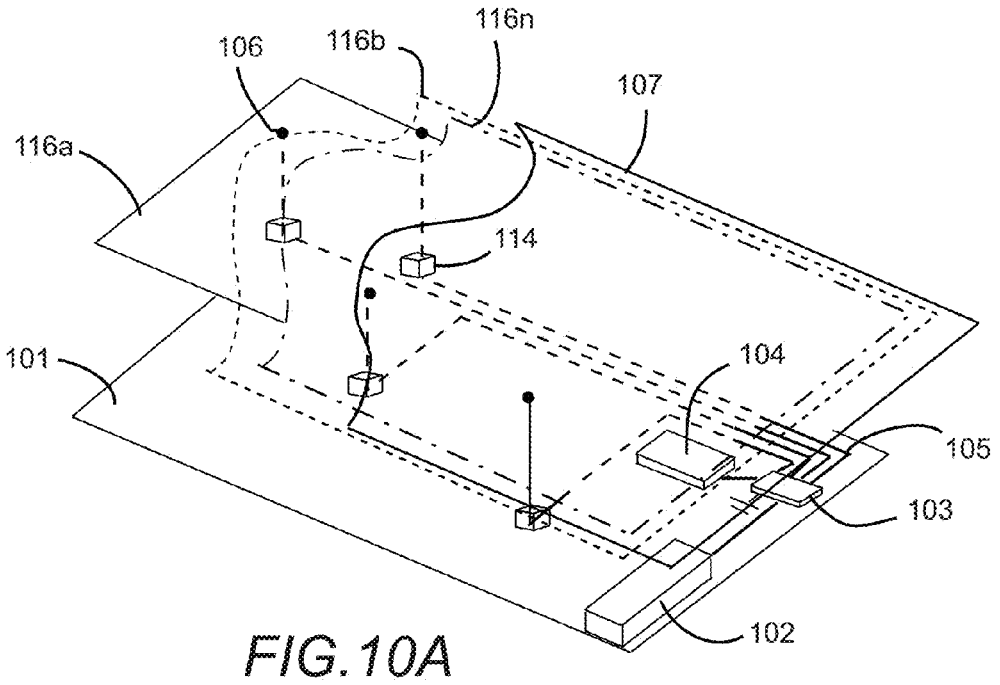
FIGS. 10(A-B) illustrate an antenna system similar to the antenna system described in FIG. 9 except now there are N coupling layers instead of one.
Figure 10B:
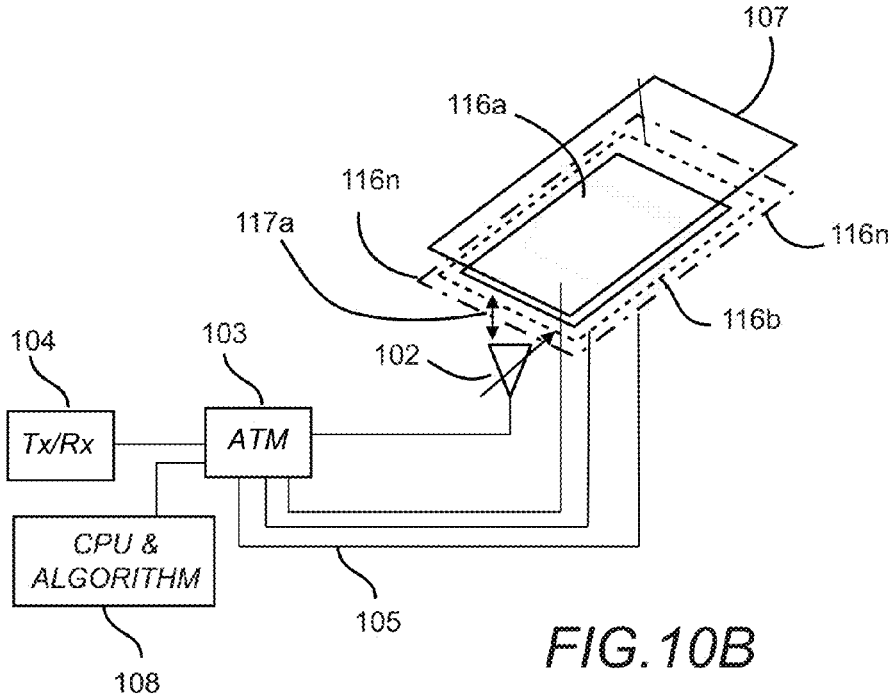

FIGS. 10(A-B) illustrates an example of an antenna system similar to the antenna system described in FIG. 9 except here there are "N" coupling layers 116*a*; 116*b*; 116*n* instead of one.

Figure 11A:
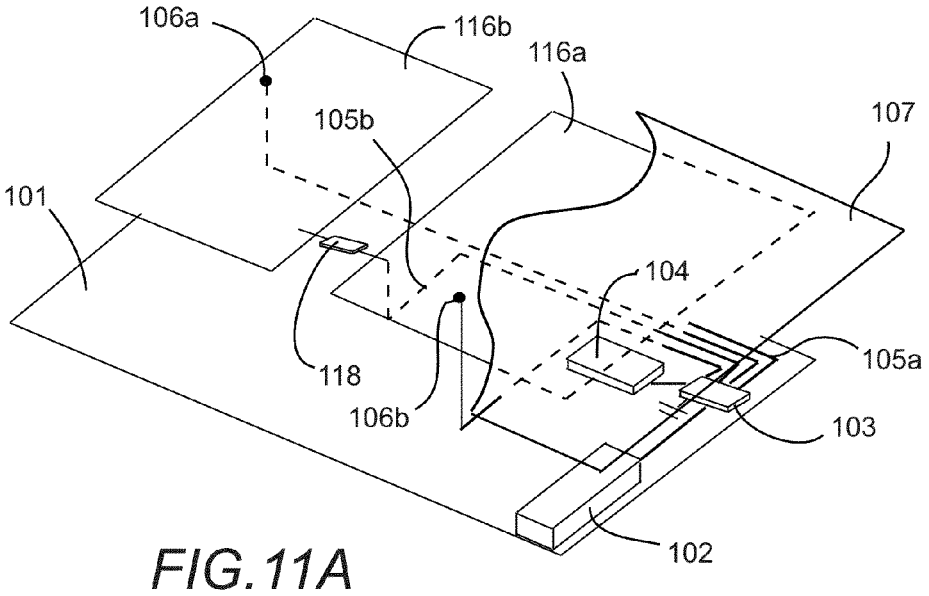
FIGS. 11(A-B) illustrate an antenna system where a single coupling layer is positioned between the antenna and the metal housing.
Figure 11B:
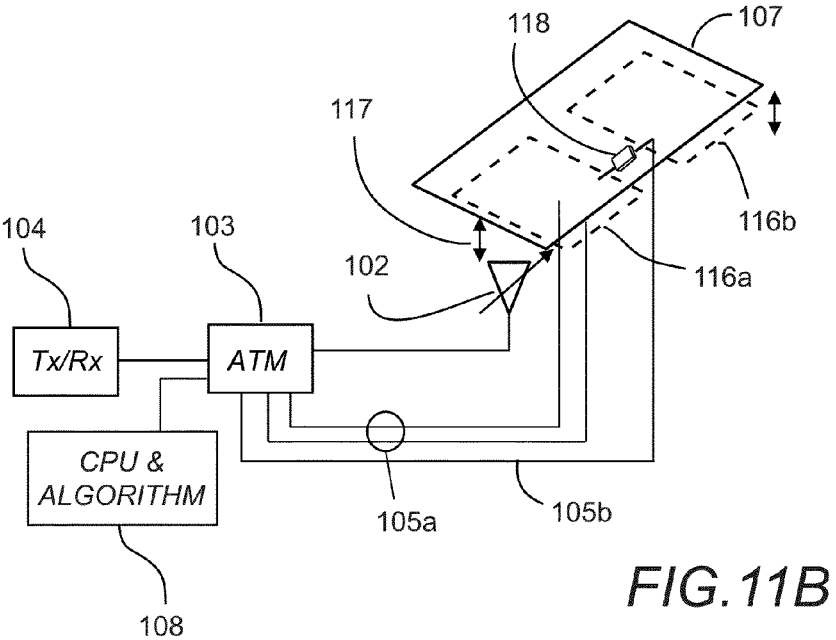
Figure 12A:
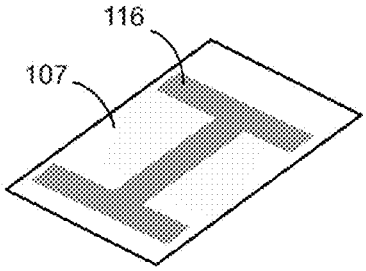
FIGS. 12(A-G) illustrate possible coupling layer geometries.
Figure 12B:
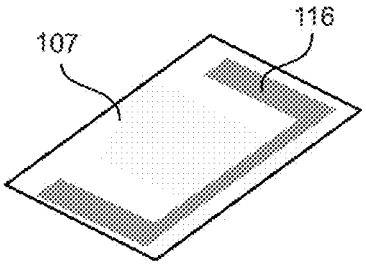
Figure 12C:
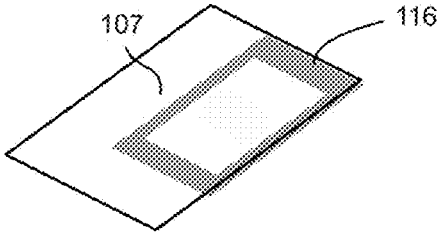
Figure 12D:
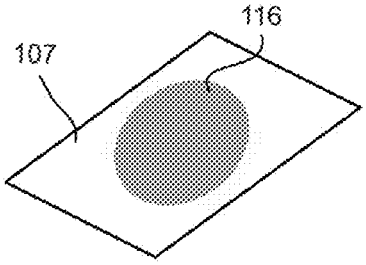
Figure 12E:
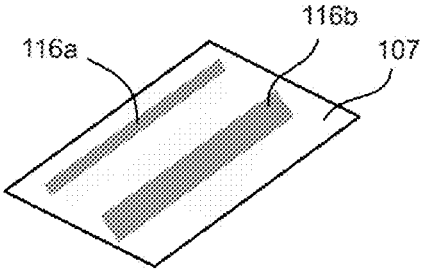
Figure 12F:
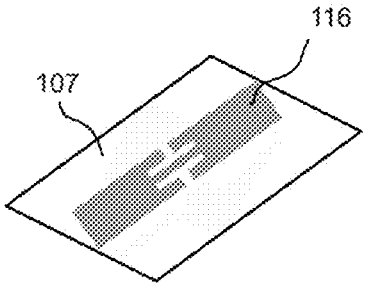
Figure 12G:
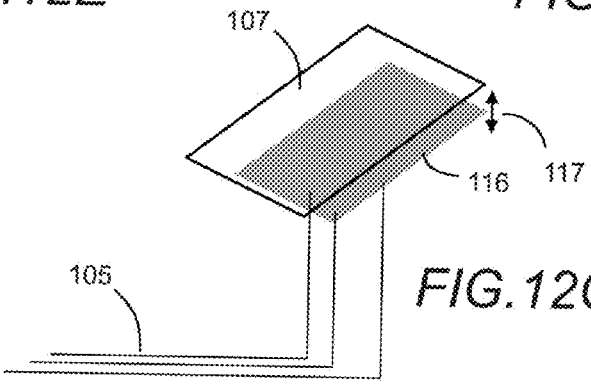

FIGS. 11(A-B) illustrate an antenna system where a single coupling layer is positioned between the antenna and the metal housing. The coupling layer is separated into two portions 116*a*; 116*b*, respectively, and a tunable component 118 is used to connect or couple the two portions. The block diagram of FIG. 11B illustrates that the ATM 103 provides control signals 105*a* for the connection points, and control signal 105*b* for the tunable component used to couple the portions of the coupling layer, and contains tuning components for the antenna element 102. Other features are similar to the above embodiments with reference to the respective reference signs.

FIGS. 12(A-G) illustrate examples of possible coupling layer geometries. The metal housing 107 is shown positioned adjacent to the respective coupling layers 116. A corresponding coupling region 117 is illustrated in FIG. 12G. Control lines 105 are shown for dynamically loading the metallized housing 107 and/or the coupling layer 116.

Figure 13:
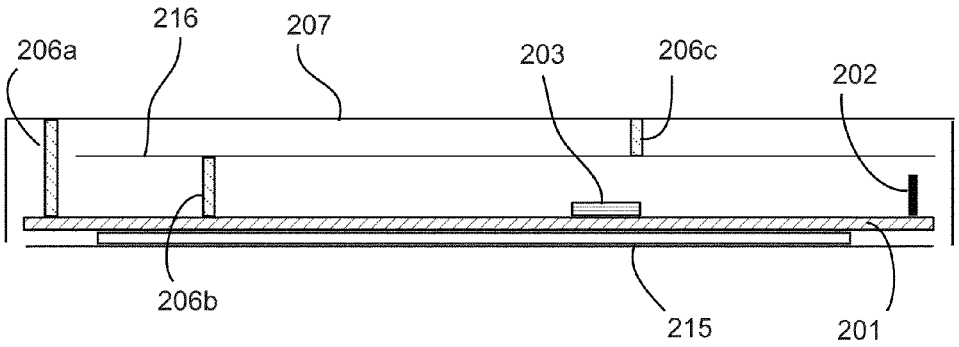
FIG. 13 illustrates an example of interconnection between the different conductors in the antenna system with a metallic enclosure.
Figure 14:
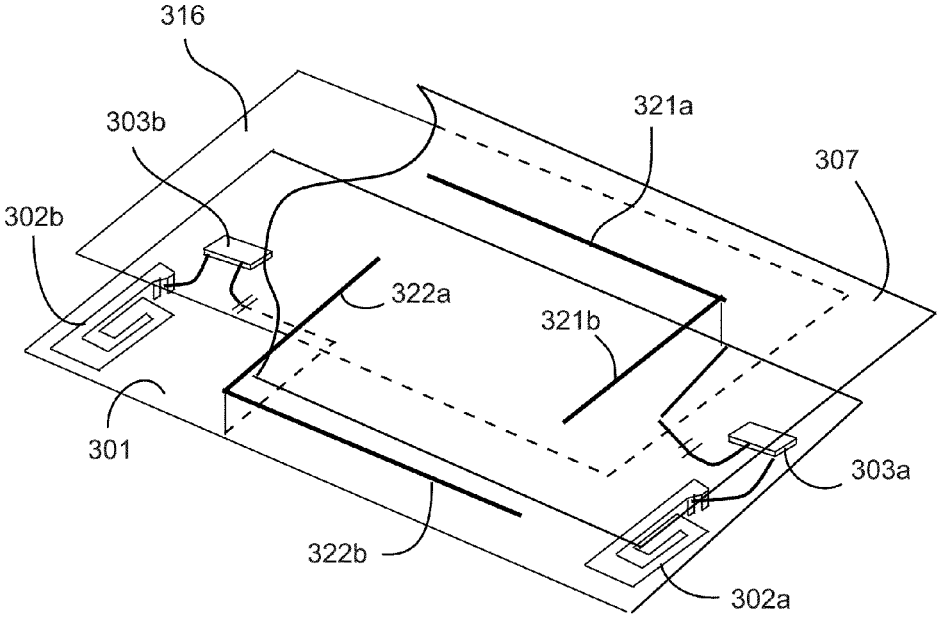
FIG. 14 illustrates an example of utilizing parasitic elements placed along the plane of the PCB orthogonal to the antenna elements or placing the parasitic elements parallel to the antenna elements.

FIG. 13 illustrates an example of interconnection between the different conductors in the antenna system with a metallic enclosure of a wireless device. An antenna tuning module (ATM) 203 is disposed on the circuit board. The first conductor 206*a* which constitutes the ground plane 201 for the antenna element 202 can be connected to the second conductor 216 which in this case would be a floating metal layer and also connected to the third conductor 207 which would be the metal back housing for the device. There can be one or more additional connection points 206*b*; 206*c* between the second conductor and the third conductor. Based on the shape of the second conductor it is possible to produce different resonant frequencies by connecting it to the metal housing 207.

FIG. 14 illustrates an example of utilizing parasitic elements placed along the plane of the PCB orthogonal to the antenna elements 302*a*; 302*b* or placing the parasitic elements parallel to the antenna elements. The parasitic elements 321; 322 will also couple with the conducting layer 316 which will be placed between the reference ground plane 301 and the metal housing 307. First parasitic element 321 is shown having two orthogonal portions 321*a* and 321*b*; while second parasitic element 322 is shown having two orthogonal portions 322*a* and 322*b*. The parasitic elements may be provided with a single portion or with multiple portions as shown.

The invention claimed is:

1. An antenna system, comprising:

an antenna element positioned adjacent to a metallized housing such that the antenna element is configured to excite currents on the metallized housing thereby resulting in radiation from a combination of the antenna element and metallized housing, the antenna element being coupled to an antenna tuning module, the antenna tuning module comprising a first tunable capacitor configured to couple with the antenna element at a feed point thereof;

the antenna tuning module further comprising:

a switch including at least a first switch port and a second switch port, each of the first and second switch ports adapted to independently connect to the metalized housing at a distinct location thereon, wherein the switch is configured to selectively couple one of the first and second switch ports to a ground connection; and a second tunable capacitor having a first end thereof configured to couple with the one of the first and second switch ports selected by the switch and a second end thereof configured to couple with the ground connection;

wherein:

the antenna tuning module is configured to vary a capacitance associated with the first tunable capacitor for tuning the antenna element;

the antenna tuning module is further configured to select between the first switch port and the second switch port for selectively grounding the metallized housing; and the antenna tuning module is further configured to adjust the second tunable capacitor for varying a reactive load associated with the metallized housing.

2. The antenna system of claim 1, further comprising:

a first transmission line configured to couple the first switch port to a first connection point associated with the metallized housing, and a second transmission line configured to couple the second switch port to a second connection point associated with the metallized housing, the second connection point being distinct from the first connection point.

3. The antenna system of claim 1, wherein:

said antenna tuning module is further coupled to a CPU, the CPU being programmed to execute an algorithm for determining a tuning state from a plurality of possible tuning states for each of the antenna element and the metallized housing, wherein the antenna element and the metallized housing are each configured with a distinct impedance or reactive load, respectively, in each of the tuning states.

4. The antenna system of claim 3, wherein:

the tuning state is determined based on a device use case, wherein said device use case is selected from: no body loading; hand loading of the device; or hand and head loading of the device.

5. The antenna system of claim 1, wherein:

each of the first and second tunable capacitors is individually configured via input controls signals.

6. The antenna system of claim 2, wherein:

at least one of the first and second transmission lines is further coupled to a tunable loading component, said tunable loading component being positioned outside of the antenna tuning module, wherein the antenna tuning module is configured to communicate a control signal with the tunable loading component, and wherein the tunable loading component is coupled to one or the first and second connection points of the metallized housing.

7. The antenna system of claim 1, wherein:

the metallized housing forms at least a portion of a device case.

8. The antenna system of claim 1, further comprising:

a second antenna element.

9. The antenna system of claim 8, further comprising:

a second antenna tuning module coupled to the second antenna element forming a second tunable antenna.

10. The antenna system of claim 2, wherein: further comprising:

a second antenna element; and a second antenna tuning module coupled to the second antenna element forming a second tunable antenna;

the second antenna tuning module is coupled to a third connection point of the metallized housing via a third transmission line extending therebetween.

11. The antenna system of claim 1, further comprising:

a coupling layer, the coupling layer including a conductor positioned adjacent to the metallized housing; wherein a volume between the coupling layer and the metallized housing forms a coupling region.

12. The antenna system of claim 11, wherein:

the coupling layer is coupled to the antenna tuning module via a transmission line extending therebetween;

wherein the antenna tuning module is configured to adjust a reactive load of the coupling layer for tuning the antenna system.

13. The antenna system of claim 11, further comprising:

a plurality of coupling layers positioned adjacent to the metallized housing, at least one of the coupling layers being coupled to the antenna tuning module for adjusting a reactive load thereof.

14. The antenna system of claim 1, further comprising:

one or more parasitic elements positioned adjacent to the antenna element;

the parasitic elements being coupled to the antenna tuning module, wherein the antenna tuning module is configured to adjust a reactive load of the parasitic elements for varying a radiation pattern characteristic of the antenna system.

15. The antenna system of claim 2, wherein:

at least one of the first and second transmission lines is further coupled to a reactive load.

* * * * *